US007884532B2

(12) United States Patent
Lee et al.

(10) Patent No.: US 7,884,532 B2
(45) Date of Patent: Feb. 8, 2011

(54) BACKLIGHT UNIT AND LIQUID CRYSTAL DISPLAY INCLUDING THE SAME

(75) Inventors: Kwang Hoon Lee, Anyang-si (KR); Jun Young Lee, Yongin-Si (KR); Sung Wook Kang, Seoul (KR); Joon Gon Son, Asan-Si (KR); Cheol Hun Lee, Yongin-Si (KR); Pil Nam Lim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1073 days.

(21) Appl. No.: 11/562,151

(22) Filed: Nov. 21, 2006

(65) Prior Publication Data

US 2007/0188102 A1 Aug. 16, 2007

(30) Foreign Application Priority Data

Feb. 16, 2006 (KR) ..... 10-2006-0015019

(51) Int. Cl.
*H01J 1/50* (2006.01)

(52) U.S. Cl. ..... 313/161; 313/35

(58) Field of Classification Search ..... 313/161, 313/118, 35

See application file for complete search history.

(56) References Cited

U.S. PATENT DOCUMENTS 5,998,934 A * 12/1999 Mimasu et al. ..... 315/118

FOREIGN PATENT DOCUMENTS

JP 58016458 A * 1/1983

* cited by examiner

*Primary Examiner*—Joseph L Williams
(74) *Attorney, Agent, or Firm*—F. Chau & Associates, LLC

(57) ABSTRACT

A backlight unit using a microwave plasma ultraviolet lamp as a light source and a liquid crystal display including the backlight unit. The backlight unit for a liquid crystal display comprises a tube filled with discharge gas, a cavity resonator in which one end of the tube is inserted, a magnetron for generating microwaves and supplying the generated microwaves to the cavity resonator, a magnetron driver for driving the magnetron, and a phosphor layer for converting ultraviolet light generated in the tube into visible light.

14 Claims, 6 Drawing Sheets

BACKLIGHT UNIT AND LIQUID CRYSTAL DISPLAY INCLUDING THE SAME

BACKGROUND OF THE INVENTION

1. Technical Field

The present disclosure relates to a backlight unit, and more particularly, to a backlight unit using a microwave plasma ultraviolet lamp as a light source and a liquid crystal display including the same.

2. Discussion of the Related Art

A liquid crystal display (LCD) is a device in which a desired image is displayed on a liquid crystal display panel by adjusting the transmissivity of light passing through the panel. A transmissive or transflective LCD, except a reflective LCD using external incident light such as natural light, may employ a backlight unit as a light source to display an image. A fluorescent lamp has been used as the light source of the backlight unit.

The backlight unit has been classified into an edge type and a direct type according to the position of the light source. In the direct type backlight unit, a plurality of light sources are placed below an LCD panel to directly irradiate a front surface of the LCD panel. On the other hand, in the edge type backlight unit, a light guide plate is installed below an LCD panel and a light source is installed to a side of the light guide plate such that light incident on the side of the light guide plate can be vertically outputted and irradiated to the LCD panel.

A fluorescent lamp such as a cold cathode fluorescent lamp (CCFL) has been used as a light source. A fluorescent lamp may comprise a lamp tube including a tube body made of glass, a phosphor layer formed on an inner surface of the tube body and a discharge gas such as mercury filled in the tube body. The fluorescent lamp may also include an electrode unit including lamp electrodes disposed respectively at inner and outer sides of the tube body and a lead. In the fluorescent lamp so configured, when electric power is applied to the lamp electrodes from the outside through the lead, electrons existing in the lamp tube collide against the electrodes to thereby generate secondary electrons. The secondary electrons collide against the discharge gas in the tube body to thereby generate ultraviolet light. Such ultraviolet light is converted into visible light while passing through the phosphor layer.

A large amount of heat is generated from the fluorescent lamp during this process. Further, lowering of brightness, and non-uniform emission of light, for example, occur over time due to, for example, phosphor layer degradation, and electrode contamination. Since the expected life of the liquid crystal display is dependent on the expected life of the fluorescent lamp, the above factors lower the expected life and reliability of the liquid crystal display. Further, the heat generated from the fluorescent lamp causes deformation of the fluorescent lamp and several optical sheets disposed adjacent to the fluorescent lamp, and thus, the entire backlight unit may malfunction. Furthermore, the number of the fluorescent lamps and inverters corresponding to the number of fluorescent lamps causes increased manufacturing costs of the backlight unit and spatial limitations on the backlight unit upon the installation thereof.

SUMMARY OF THE INVENTION

According to an embodiment of the present invention a backlight unit for a liquid crystal display, comprises at least one tube filled with discharge gas, a cavity resonator in which one end of the tube is partially inserted, a magnetron for generating microwaves and supplying the generated microwaves to the cavity resonator, a magnetron driver for driving the magnetron, and a phosphor layer for converting ultraviolet light generated in the tube into visible light.

The backlight unit may further comprise a diffusion sheet disposed above the tube, wherein the phosphor layer is formed on one surface of the diffusion sheet. The backlight unit may further comprise a reflection sheet disposed below the tube, wherein the reflection sheet includes an ultraviolet ray reflection sheet.

The phosphor layer may be formed on an inner or outer surface of the tube.

The backlight unit may further comprises a light guide plate of which one side is disposed adjacent to the tube, wherein the phosphor layer is formed on the side of the light guide plate disposed adjacent to the tube.

Alternatively, the backlight unit may further comprise a light guide plate of which one side is disposed adjacent to the tube, wherein the phosphor layer is formed on an upper surface of the light guide plate. The backlight unit may further comprise a reflection sheet disposed below the light guide plate, wherein the reflection sheet includes an ultraviolet ray reflection sheet.

The backlight unit may further comprise a tube reflection sheet disposed around the tube to reflect incident light to a side of the light guide plate, wherein the tube reflection sheet includes an ultraviolet ray reflection sheet.

The magnetron may be integrally formed with the cavity resonator.

The one end of the tube may be inserted in the cavity resonator at a depth of about 8 mm to about 12 mm.

A plurality of tube mounting holes may be formed on one side of the cavity resonator and the end of the tube may be inserted in one of the tube mounting holes.

According to another embodiment of the present invention, a liquid crystal display comprises a liquid crystal display panel, a backlight unit for providing visible light to the liquid crystal display panel, and a receiving case for receiving the backlight unit therein.

The phosphor layer may be formed on a floor surface of the receiving case.

The magnetron driver may be installed on the floor surface or a bottom surface of the receiving case.

Alternatively, the magnetron driver may be installed in a space between a side of the light guide plate and sides of the magnetron and cavity resonator.

BRIEF DESCRIPTION OF THE DRAWINGS

Exemplary embodiments of the present invention can be understood in more detail from the following description taken in conjunction with the accompanying drawings, in which.

DETAILED DESCRIPTION OF THE EXEMPLARY EMBODIMENTS

Exemplary embodiments of the present invention will be described in detail with reference to the accompanying drawings. The present invention may, however, be embodied in many different forms and should not be construed as being limited to the embodiments set forth herein.

Figure 1:
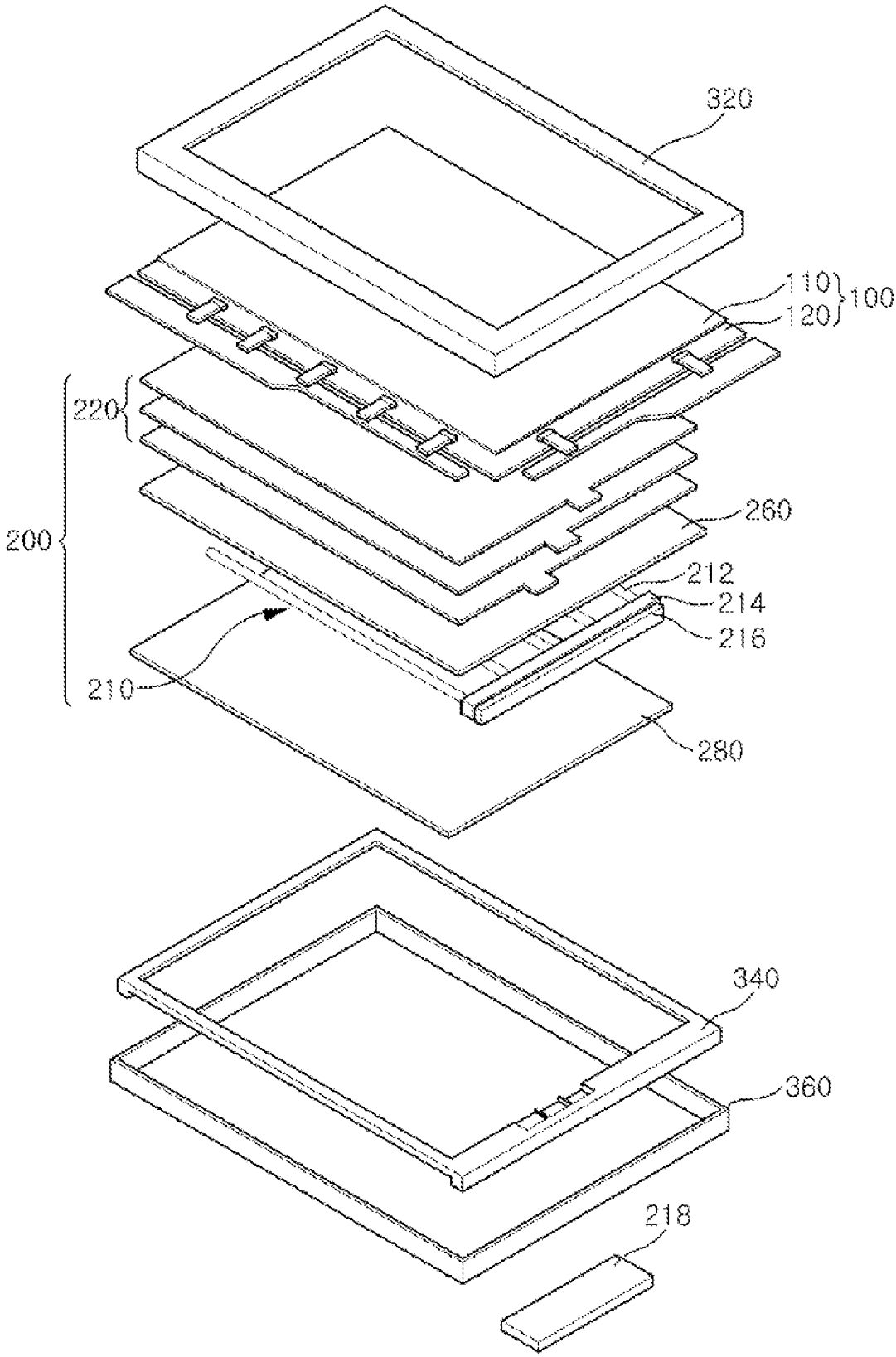
FIG. 1 is a schematic exploded perspective view of a direct type backlight unit and a liquid crystal display including the backlight unit according to an embodiment of the present invention.
Figure 2:
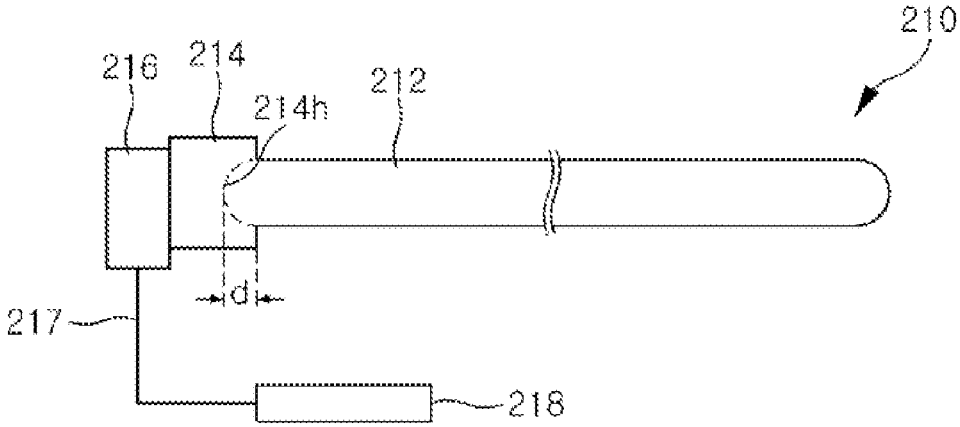
FIG. 2 is a view schematically showing the constitution of a light source for use in a backlight unit according to an embodiment of the present invention.
Figure 3:
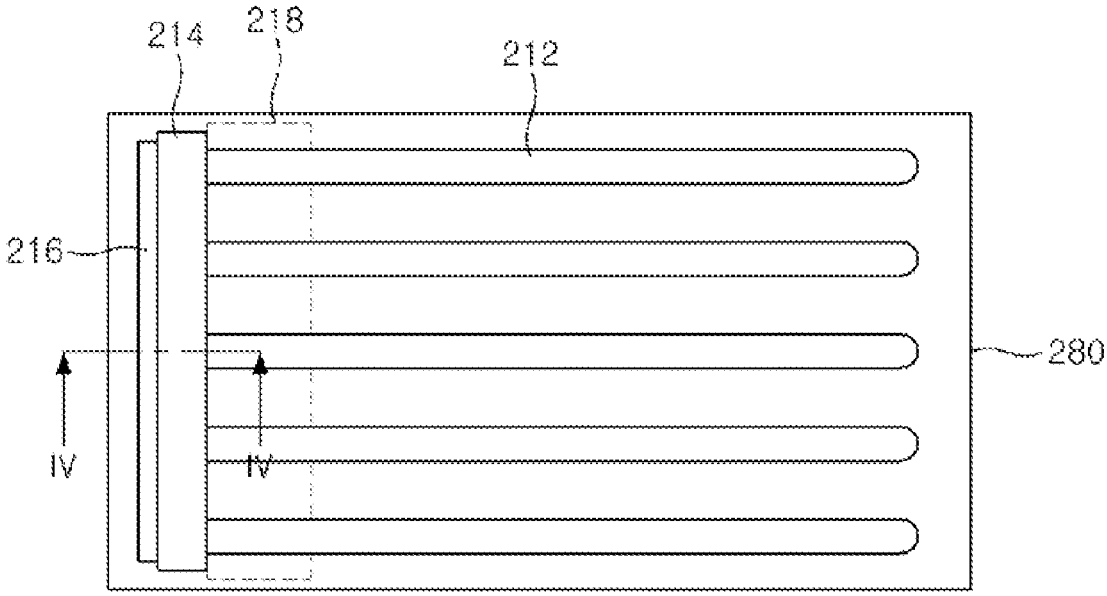
FIG. 3 is a plan view of a backlight unit according to an embodiment of the present invention.
Figure 4:
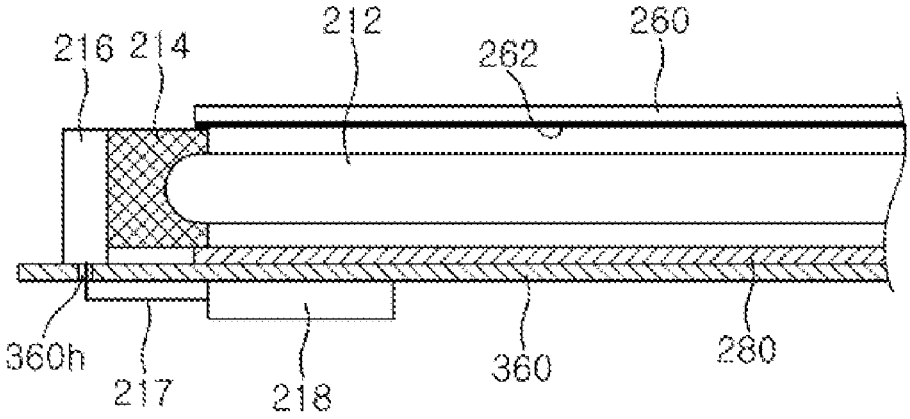
FIG. 4 is a sectional view of a backlight unit taken along line IV-IV of FIG. 3.
Figure 5:
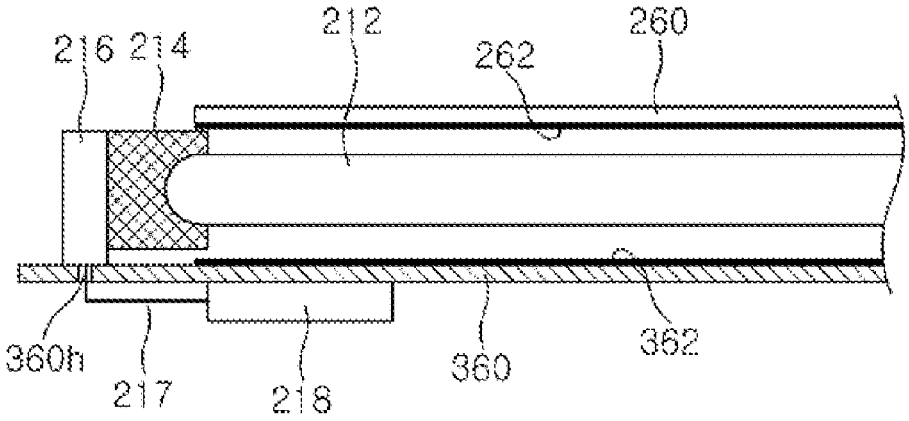
FIGS. 5 and 6 are sectional views of backlight units according to embodiments of the present invention.
Figure 6:
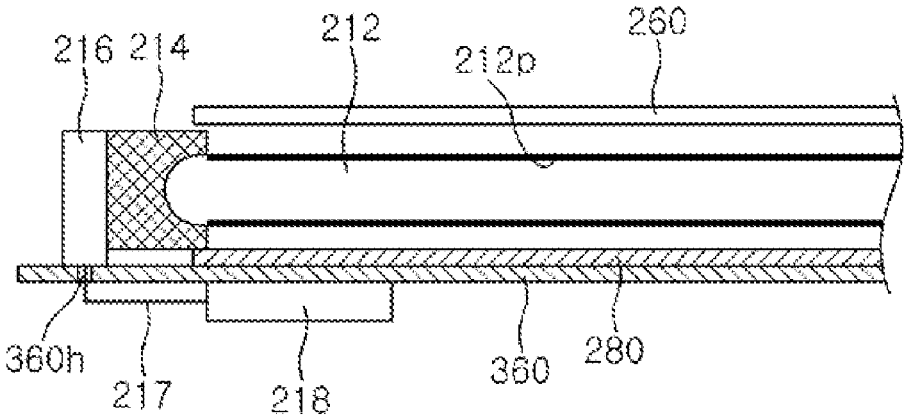

FIG. 1 is a schematic exploded perspective view of the direct type backlight unit and the liquid crystal display including the backlight unit according to an embodiment of the present invention. FIG. 2 is a view schematically showing the constitution of a light source for use in a backlight unit according to an embodiment of the present invention. FIG. 3 is a plan view of a backlight unit according to an embodiment of the present invention. FIG. 4 is a sectional view taken along line IV-IV of FIG. 3. FIGS. 5 and 6 are sectional views backlight units according to embodiments of the present invention.

Referring to FIG. 1, a liquid crystal display according to an embodiment of the present invention comprises a liquid crystal display panel 100 including a first substrate 110, for example, a color filter substrate, a second substrate 120, for example, a thin film transistor substrate, and a liquid crystal layer interposed between the two substrates. The liquid crystal display also includes a backlight unit 200 for providing light to the liquid crystal display panel 100, and a receiving case which includes an upper chassis 320, a mold frame 340 and a lower chassis 360. The receiving case supports and protects both the liquid crystal display panel 100 and the backlight unit 200.

The backlight unit 200, which is disposed below the liquid crystal display panel 100, comprises a light source 210 for generating light, a diffusion sheet 260 disposed above the light source 210 to diffuse light generated from the light source 210, a plurality of optical sheets 220 disposed between the diffusion sheet 260 and the liquid crystal display panel 100 to convert light incident onto the diffusion sheet into a desired pattern, and a reflection sheet 280 for upwardly reflecting light leaked downward from the light source 210.

According to an embodiment of the present invention, a microwave plasma ultraviolet lamp (MPUVL) is used as the light source 210. The microwave plasma ultraviolet lamp uses microwaves as the energy source. In such a case, since the microwaves easily penetrate a dielectric due to their characteristics as an energy source, no electrodes are necessary. Furthermore, a small amount of heat is generated from the microwave plasma ultraviolet lamp. The microwave plasma ultraviolet lamp has a long expected life and improved efficiency. In addition, it is possible to manufacture the microwave plasma ultraviolet lamp in various shapes.

The light source 210 comprises a plurality of glass tubes 212, a cavity resonator 214 disposed at one end of the glass tubes 212, a magnetron 216 for generating microwaves and supplying the generated microwaves to the cavity resonator 214, a magnetron driver 218 for supplying electric power to drive the magnetron 216, and a cable 217 that connects the magnetron 216 to the magnetron driver 218.

Each of the glass tubes 212 is made of, for example, quartz glass through which ultraviolet light can pass or glass which does not contain quartz and has been developed for the ultraviolet light. Each of the glass tubes is formed into a hermetically sealed hollow cylindrical shape. The interior of the glass tube 212 is filled with, for example, argon or mercury serving as a discharge gas. The interior of the glass tube 212 is kept in a vacuum state of about 0.01 Torr such that the plasma can be easily generated.

The glass tubes 212 are installed in such a manner that one end of each glass tube is inserted into the cavity resonator 214 by a predetermined depth d. That is, a plurality of tube mounting holes **214*h*, each of which has a depth d of about 8 to about 12 mm, and preferably about 10 mm, are formed on a lateral surface of the cavity resonator 214 and spaced apart at regular intervals. One end of the glass tube 212 is inserted in the tube mounting hole 214*h*. Alternatively, a cavity resonator and a magnetron can be provided for each of the glass tubes 212**.

The magnetron 216 includes a diode composed of a cathode and an anode, and a magnet installed to impose magnetic fields in a direction perpendicular to a direction connecting the cathode and the anode. If electric power is applied to the cathode and anode of the magnetron 216 from the magnetron driver 218 through the cable 217, electrons move from the cathode to the anode to create oscillating current. As a result, microwaves are generated with a frequency of about 300 MHz to about 300 GHz, and preferably about 2.45 GHz.

The microwaves are transmitted into the cavity resonator 214 and then resonated in the cavity resonator. Microwaves generated in the magnetron may be transferred into the cavity resonator through a waveguide. In an embodiment of the present invention, the magnetron 216 is integrally formed with the cavity resonator 214 in order to simplify the structure of and reduce the size of the light source. Thus, it is possible to eliminate the waveguide.

Since one end of the glass tube 212 filled with discharge gas is inserted in the tube mounting hole **214*h* of the cavity resonator 214, microwaves in the cavity resonator 214 are resonated to generated plasma in the glass tube 212. That is, since microwaves easily pass through a dielectric such as glass, the microwaves pass though the glass tube 212** and are then applied to the discharge gas in the glass tube. Electrons of atoms of the discharge gas absorb microwave energy, and thus, the atoms of the discharge gas are divided into ions and free electrons at higher energy levels. The ions and free electrons can generate plasma where they coexist while maintaining the same densities, and simultaneously emit ultraviolet light. Since the microwave plasma ultraviolet lamp so constructed has low heat emission and no phosphors, there are no reductions in the expected life span caused by heat or in the brightness caused by the degradation of phosphors.

In order to apply the microwave plasma ultraviolet lamp so constructed to the direct type liquid crystal display, the cavity resonator 214 and the magnetron 216 are arranged along an edge of the liquid crystal display. As shown in the figures, the cavity resonator 214 and the magnetron 216 are preferably disposed at a shorter one of the edge sides of the liquid crystal display to extend as long as a length of the side. The cavity resonator 214 and the magnetron 216 have a rectangular shape. The cavity resonator 214 and the magnetron 216 are fixedly installed onto a floor surface of the lower chassis 360.

As described above, the plurality of tube mounting holes **214*h* are formed on a lateral surface of the cavity resonator 214 and spaced apart from each other at regular intervals. One end of the glass tube 212 is inserted into each of the corresponding tube mounting holes 214***h*, and thus, a plurality of the glass tubes 212 are arranged in parallel to one another. Tube holders (not shown) may be provided at at the other end of and a middle portion of the glass tube 212 to fix the glass tube 212. The glass tubes 212 and the tube holders can have the same shapes and arrangements as a cold cathode fluorescent lamp of a known backlight unit and a tube holder used therein. That is, since a tube holder for supporting the middle portion of the fluorescent lamp in a conventional backlight unit may be used to support the middle portion and the other end of the glass tube 212 of an embodiment of the present invention, an interval between the two adjacent glass tubes 212 and a gap between the glass tube and the reflection sheet 280 can be kept constant.

The magnetron driver 218 for driving the magnetron 216 is preferably thin and compact, so that it can be installed on the bottom surface of the lower chassis 360. Alternatively, the magnetron driver 218 may be installed on the floor surface of the lower chassis 360, i.e., between the reflection sheet 280 and the lower chassis 360. Furthermore, the magnetron driver 218 can be disposed at a position adjacent to a printed circuit board depending on the arrangement of the printed circuit board. The printed circuit board may include a driving circuit for transmitting an external signal to the liquid crystal display panel.

Referring to FIGS. 4-6, in a case where the magnetron driver 218 is installed on the bottom surface of the lower chassis 360, the magnetron 216 and the magnetron driver 218 are connected to each other by the cable 217 through a through-hole 360*h* formed on the lower chassis 360. Alternatively, in a case where the magnetron driver 218 is installed on the floor surface of the lower chassis 360, the magnetron driver 218 can be connected directly to the magnetron 216 without the cable.

If ultraviolet light is emitted from the glass tubes 212, as the glass tubes 212, the cavity resonator 214, the magnetron 216 and the magnetron driver 218 so arranged are operated, the ultraviolet light should be converted into visible light and incident to the liquid crystal display panel 100. To this end, a phosphor layer 262 is formed on a surface, for example, a bottom surface of the diffusion sheet 260 disposed above the glass tubes 212.

Phosphor coating liquid or slurry, for example, is applied onto the bottom surface of the diffusion sheet 260 and then dried to form the phosphor layer 262. A halophosphate phosphor, for example, is used in the phosphor layer 262 to convert ultraviolet light into white visible light. Alternatively, a blue (B) light-emitting phosphor, a green (G) light-emitting phosphor and a red (R) light-emitting phosphor are mixed at a certain mixing ratio and can be then used for forming the phosphor layer. As described above, the white visible light obtained by converting ultraviolet light into blue, green and red visible light and then mixing the blue, green and red light with one another is highly efficient and results in an improved color image.

In a case where the phosphor layer 262 is formed on the bottom surface of the diffusion sheet 260 as shown in FIG. 4, an ultraviolet ray-reflection sheet may be employed as the reflection sheet 280. The reflection sheet 280 may be formed on all the regions except the top of the glass tubes 212. That is, an additional reflection sheet or layer (not shown) may be further formed on a side surface of the cavity resonator 214 (except the tube mounting holes 214*h*), on which the tube mounting holes 214*h* are formed, and on side surfaces adjacent to the other ends of the glass tubes 212 and adjacent the outer surfaces of the glass tubes 212. The reflection layer may be coated on a surface of a member, such as a mold frame, placed at a side edge of the glass tube 212, which is opposite to the glass tube 212. The reflection sheet or layer formed on the side surface may reflect the incident ultraviolet light upwardly and/or downwardly.

The reflection sheet is disposed not only below the glass tubes 212 but also around the side surface adjacent to the glass tubes so that the reflection sheet can protect components disposed around the glass tubes 212 from the ultraviolet light as well as reflect the ultraviolet light upwardly. The reflection sheet or layer should be resistant to ultraviolet light. Since a portion of the mold frame 340 made of a resin can be disposed around the glass tubes 212, the mold frame 340 may be exposed to and deformed by the ultraviolet light. Accordingly, if the reflection sheet or layer is not formed around the glass tubes 212, components made of a material resistant to ultraviolet light can be disposed around the glass tubes 212.

In an alternative embodiment, the phosphor layer may be implemented by installing a phosphor plate or sheet with the phosphor layer formed thereon.

The phosphor layer can be formed at a position other than the bottom surface of the diffusion sheet 260. As shown FIGS. 5 and 6, for example, the phosphor layers may be formed at various positions to convert ultraviolet light emitted from the glass tubes 212 into visible light.

As shown in FIG. 5, a phosphor layer 362 can be formed on a floor surface of the lower chassis 360 and the reflection sheet 280 below the glass tubes 212 can be eliminated. The additional phosphor layers may also be formed on surfaces of the components, e.g., the cavity resonator 214 and the mold frame disposed around the glass tubes 212, as well as the floor surface of the lower chassis 360. With this configuration, the phosphor layer can convert ultraviolet light into visible light and simultaneously prevent the ultraviolet light from being irradiated onto the components disposed adjacent to the glass tubes 212. The phosphor layer preferably does not absorb, but reflects the converted visible light.

Referring to FIG. 5, the magnetron driver 218 of the lower chassis 360 and the printed circuit board connected to the liquid crystal display panel are installed on the bottom surface of the lower chassis 360.

As shown in FIG. 6, the reflection sheet 280 is installed below the glass tubes 212 and a phosphor layer 212*p* is formed on an inner surface of each glass tube 212. With this configuration, an additional phosphor layer on various adjacent components such as the diffusion sheet, the lower chassis, the mold frame and the like is not required. In addition, it is not necessary to make these components from a material resistant to ultraviolet light. Alternatively, the phosphor layer 212*p* can be formed on an outer surface of each glass tube 212.

As described above, one end of the glass tube 212 is fixedly inserted into the relevant tube mounting hole 214*h* formed on one side of the cavity resonator 214, but the present invention is not limited thereto. Alternatively, two sets of cavity resonators 214 and magnetrons 216 are disposed respectively to face each other, and both ends of the glass tube 212 can be inserted into tube mounting holes 214*h* of cavity resonators 214 positioned at respective ends of the glass tubes 212. With this configuration, plasma can be smoothly generated in each of the glass tubes 212, and both ends of the glass tube 212 can be stably supported and installed by the respective cavity resonators 214.

Figure 7:
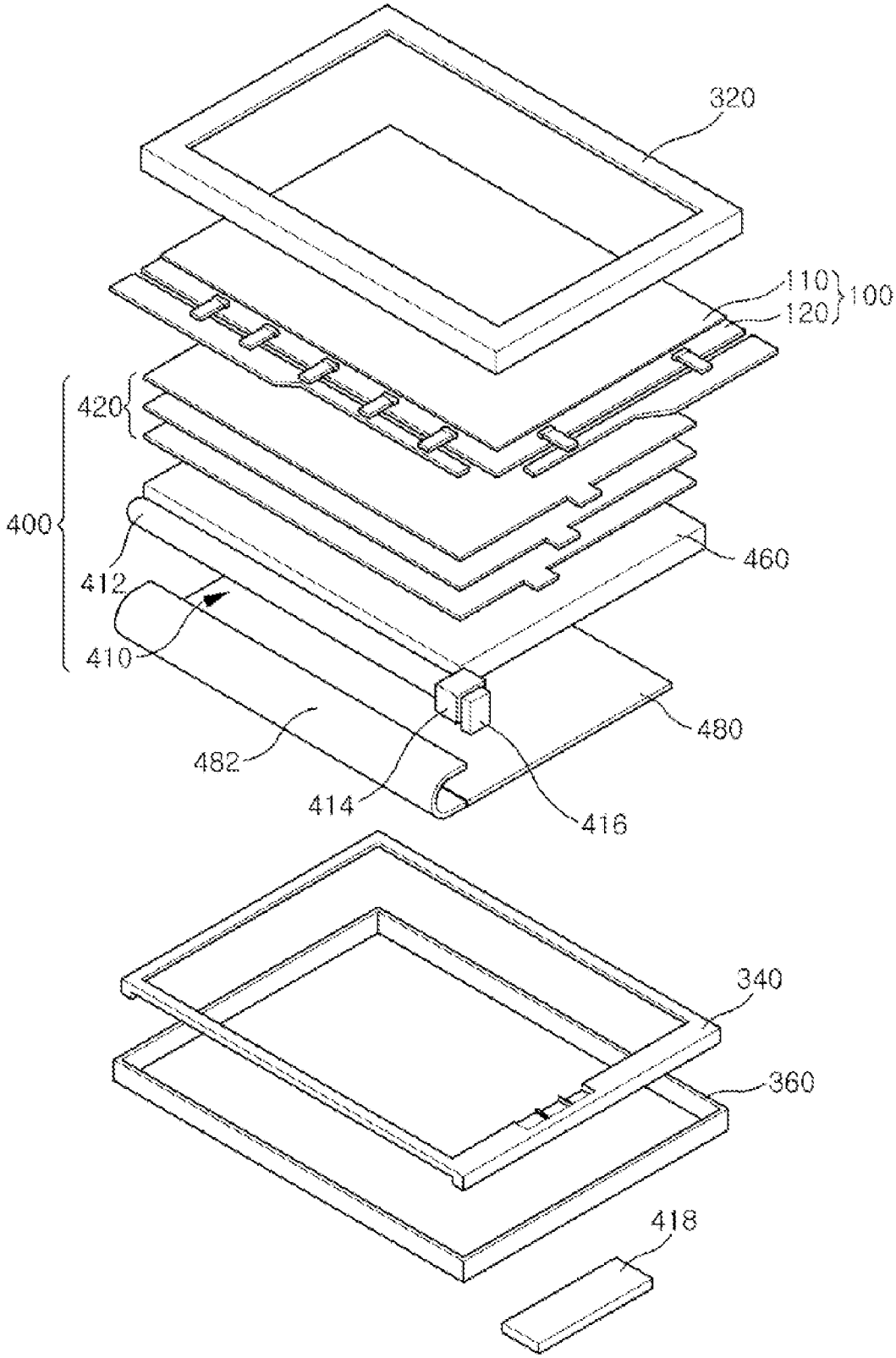
FIG. 7 is a schematic exploded perspective view of an edge type backlight unit and a liquid crystal display including the backlight unit according to an embodiment of the present invention.
Figure 8:
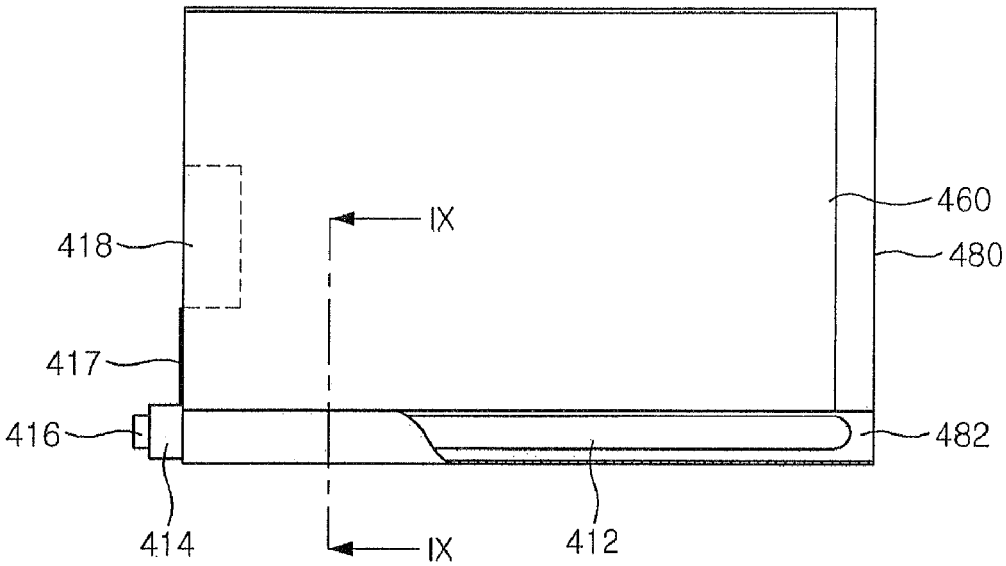
FIG. 8 is a plan view of a backlight unit according to an embodiment of the present invention.
Figure 9:
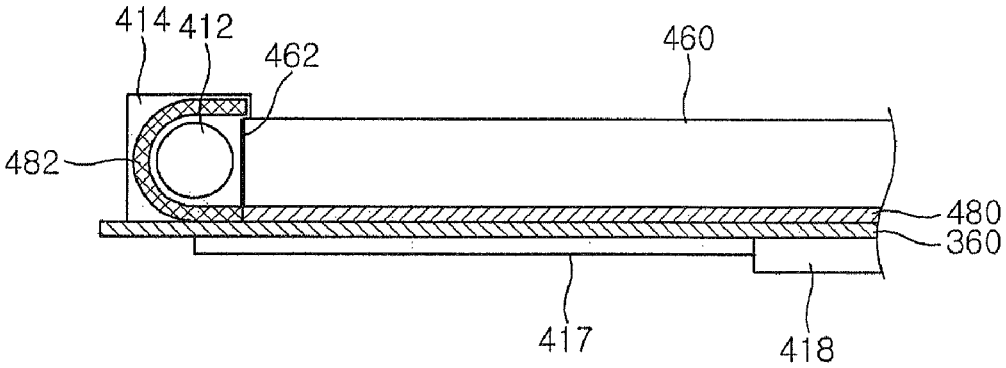
FIG. 9 is a sectional view taken along line IX-IX of FIG. 8.
Figure 10:
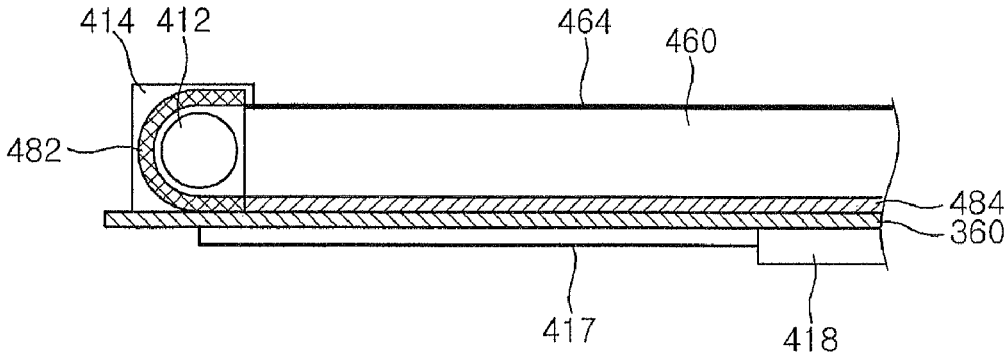
FIGS. 10-12 are sectional views of backlight units according to embodiments of the present invention.
Figure 11:
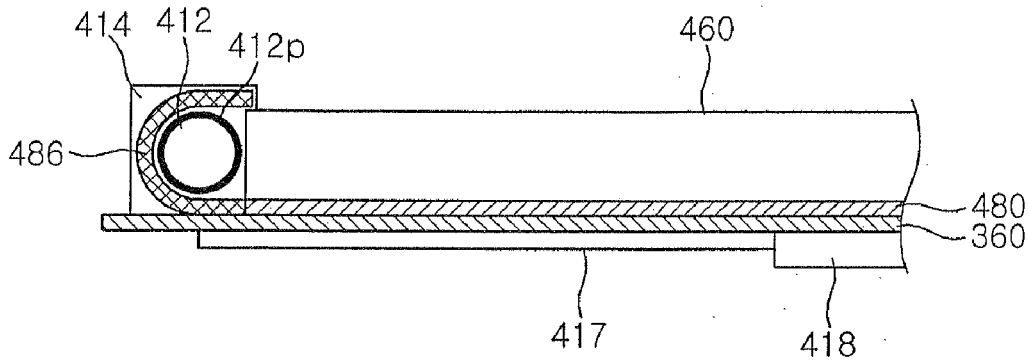
Figure 12:
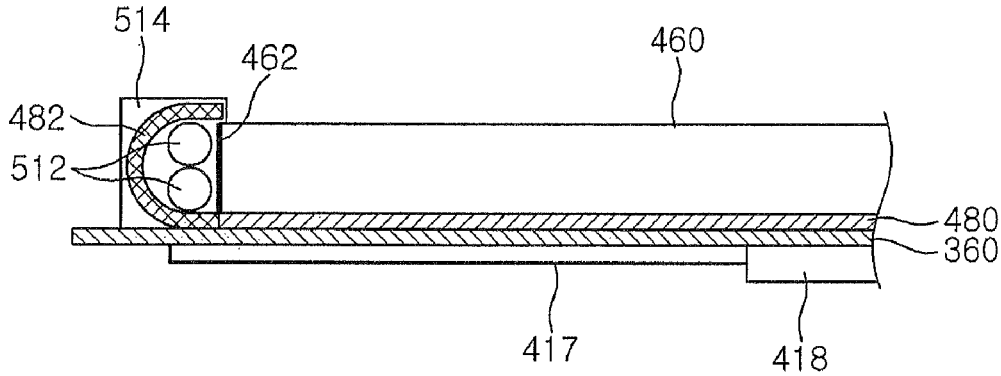
Figure 13:
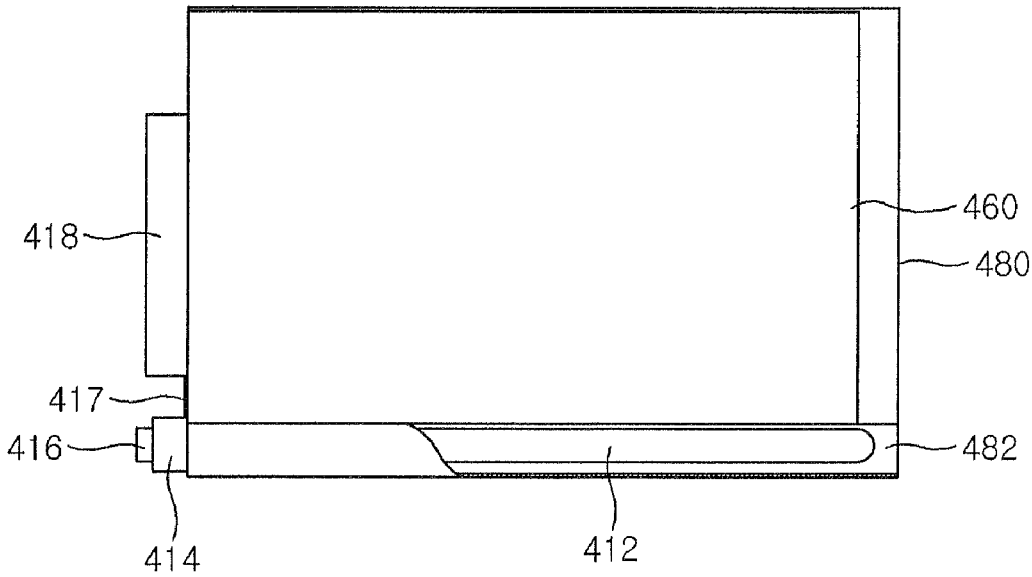
FIG. 13 is a plan view of a backlight unit according to an embodiment of the present invention.

FIG. 7 is a schematic exploded perspective view of an edge type backlight unit and a liquid crystal display including the backlight unit according to an embodiment of the present invention. FIG. 8 is a plan view of a backlight unit according to an embodiment of the present invention. FIG. 9 is a sectional view taken along line IX-IX of FIG. 8. FIGS. 10-12 are sectional views showing backlight units according to embodiments of the present invention. FIG. 13 is a plan view of a backlight unit according to an embodiment of the present invention.

Referring to FIG. 7, a liquid crystal display comprises a liquid crystal display panel 100, a backlight unit 400 for providing light to the liquid crystal display panel 100, and a receiving case which includes an upper chassis 320, a mold frame 340 and a lower chassis 360. The receiving case supports and protects the liquid crystal display panel 100 and the backlight unit 400.

The backlight unit 400 disposed below the liquid crystal display panel 100 comprises a light guide plate 460 for converting light incident from a side thereof into plane light in a vertical direction, a light source 410 installed at the one side of the light guide plate 460 to irradiate light to the side of the light guide plate 460, a plurality of optical sheets 420 disposed between the light guide plate 460 and the liquid crystal display panel 100 to convert the light irradiated from the light guide plate into a desired pattern, and a reflection sheet 480 disposed below the light guide plate 460 to upwardly reflect light leaked downward from the light guide plate 460.

Similar to the light source 210, a microwave ultraviolet lamp is used as the light source 410 of the backlight unit 400. The light source 410 comprises a glass tube 412, a cavity resonator 414 disposed at an end of the glass tube 412, a magnetron 416 for generating microwaves and supplying the generated microwaves to the cavity resonator 414, and a magnetron driver 418 connected to the magnetron 416 through a cable 417 to supply electric power to the magnetron for driving the magnetron 416.

The glass tube 412 is disposed at a side of the light guide plate 460, and the cavity resonator 414 and the magnetron 416 are disposed at an end of the glass tube 412. As shown in the figures, the glass tube 412 is disposed at a longer one of the sides of the light guide plate to extend as long as a length of the side. The cavity resonator 414 and the magnetron 416 are fixedly installed onto a floor surface of the lower chassis 360, and one end of the glass tube 412 is fixed to the cavity resonator 414 by a certain depth. A tube holder (not shown) may be disposed at the other end and a middle portion of the glass tube 412 to fix the tube 412. The tube holder can have the same shape and arrangement as a tube holder for fixing a cold cathode fluorescent lamp of a conventional edge type backlight unit.

The magnetron driver 418 for driving the magnetron 416 is preferably manufactured to be thin and compact, so that it can be installed on the bottom surface of the lower chassis 360. Alternatively, the magnetron driver 418 may be installed on the floor surface of the lower chassis 360, i.e. between the reflection sheet 480 and the lower chassis 360. Furthermore, the magnetron driver 418 can be disposed at a position adjacent to a printed circuit board depending on the arrangement of the printed circuit board. The printed circuit board may include a driving circuit for transmitting an external signal to the liquid crystal display panel.

If ultraviolet light is emitted from the glass tube 412, as the glass tube 412, the cavity resonator 414, the magnetron driver 416 and the magnetron driver 418 so arranged are operated, the ultraviolet light should be converted into visible light and incident to the liquid crystal display panel 100. To this end, as shown in FIG. 9, a phosphor layer 462 is formed on a surface of the light guide plate 460 which is opposite to the glass tube 412. Accordingly, the ultraviolet light generated in the glass tube 412 is incident onto the side of the light guide plate 460 and simultaneously converted into visible light while passing through the phosphor layer 462. The visible light is then converted into plane light in a vertical direction in the light guide plate 460 and incident onto the liquid crystal display panel 100.

Furthermore, an additional tube reflection sheet 482 is provided around the glass tube 412 except a portion of the glass tube 412 facing the side of the light guide plate 460, in addition to the reflection sheet 480 disposed below the light guide plate 460. The tube reflection sheet 482 reflects the ultraviolet light emitted from the glass tube 412 in a radial direction toward the side of the light guide plate 460 opposite the glass tube 412. The reflection sheet 480 disposed below the light guide plate 460 may be a reflection sheet for visible light and the tube reflection sheet 482 disposed around the glass tube 412 may be a reflection sheet for ultraviolet light.

Also, an additional reflection sheet or layer may be formed on the side of the cavity resonator 414 to which the end of the glass tube 412 is fixed and on positions adjacent to the other end of the glass tube 412. Alternatively, components comprising a material resistant to ultraviolet light may be disposed at the relevant positions around the glass tube 412.

In an embodiment, the phosphor layer 462 may be implemented by installing a phosphor plate or sheet with the phosphor layer formed thereon.

The phosphor layer 462 can be formed at a position other than the side of the light guide plate 460 shown in FIG. 9. As shown in FIGS. 10 and 11, the phosphor layers may be formed at various positions to convert ultraviolet light emitted from the glass tube 412 into visible light.

As shown in FIG. 10, a phosphor layer 464 can be formed on an upper surface of the light guide plate 460 instead of the side thereof. In such a case, the ultraviolet light generated in the glass tube 412 and incident onto the side of the light guide plate 460 is converted into plane light in a vertical direction and then passes through the light guide plate 460. At this time, the plane light is converted into visible light while passing through the phosphor layer 464. Since the wavelength of ultraviolet light is shorter than that of visible light, the ultraviolet light exhibits improved light guide performance when the rays or light passes through the light guide plate 460, and increased brightness uniformity can be obtained. However, since ultraviolet light is continuously incident onto the light guide plate 460, the light guide plate 460 may be damaged by the ultraviolet light. Accordingly, the light guide plate 460 should be made of a material resistant to ultraviolet light if the phosphor layer 464 is to be formed on the upper surface of the light guide plate 460.

Referring to FIG. 10, as an alternative to the reflection sheet 480, an ultraviolet ray reflection sheet may be used as the reflection sheet 484 disposed below the light guide plate 460. In addition, the tube reflection sheet 482 for reflecting ultraviolet light emitted from the glass tube 412 to the side of the light guide plate 460 is also used.

As shown in FIG. 11, a phosphor layer 412*p* is formed on an inner (or outer) surface of the glass tube 412. With this configuration, an additional phosphor layer on various adjacent components such as the light guide plate, the mold frame and the like may be omitted. Further, it is not necessary to make these components from a material resistant to ultraviolet light. Referring to FIG. 11, since both the reflection sheet 480 and the tube reflection sheet 482 are used to reflect visible light, a visible light reflection sheet can be used for the reflection sheet and tube reflection sheet.

Although it has been described that one glass tube 412 is disposed at the one side of the light guide plate 460, the present invention is not limited thereto. The glass tubes may be disposed at two opposite sides or all four sides of the light guide plate 460. Furthermore, as shown in FIG. 12, two glass tubes 512 can be installed, for example, one above another, at a side of the light guide plate 460. In this case, two tube mounting holes are formed one above another on one side of a cavity resonator 514 such that the glass tubes correspond to the tube mounting holes. The number and arrangement of the glass tubes 512 can be determined in various manners other than those shown in the figures.

Further, although it has been described that one end of the glass tube 412 is inserted into and fixed to the tube mounting hole formed on one side of the cavity resonator 414, the present invention is not limited thereto. That is, two sets of cavity resonators 414 and magnetrons 416 can be disposed at both ends of the glass tube 412, respectively, to face each other.

Since the glass tube 412 is disposed at one side of the light guide plate 460 to extend as long as a length of the one side of the light guide plate, the cavity resonator 414 and the magnetron 416 protrude from another adjacent side of the light guide plate 460 connecting to the one side thereof. Referring to FIG. 13, the magnetron driver 418 can be manufactured to have a thickness substantially the same as that of the light guide plate and a width substantially the same as the sum of the thicknesses of the cavity resonator 414 and the magnetron 416. As a result, the magnetron driver may be disposed in a space between the adjacent side of the light guide plate 460 and sides of the cavity resonator 414 and the magnetron 416. In such a case, a size of the liquid crystal display can be reduced.

In the backlight unit according to the embodiments of the present invention, a microwave plasma ultraviolet lamp is used instead of the conventional fluorescent lamp. Thus, since heat generated from the microwave plasma ultraviolet lamp is low, there is no reduction in the expected life span caused by the generated heat or in the brightness caused by the degradation of phosphors. Therefore, high and uniform brightness can occur over a longer time period. Further, the deformation of various optical sheets disposed adjacent to the lamp due to heat can be prevented.

Furthermore, the glass tube for emitting ultraviolet light according to embodiments of the present invention can be manufactured to have a shape and structure similar to those of a tube for a conventional cold cathode fluorescent lamp. Thus, the backlight unit of the embodiments of the present invention can be implemented in a conventional backlight unit without any significant design changes in the conventional backlight unit to which the cold cathode fluorescent lamp is applied.

Also, since only one magnetron driver is required in a microwave plasma ultraviolet lamp (as opposed to a plurality of inverters corresponding to a plurality of fluorescent lamps), a compact backlight unit can be obtained at low cost.

Although the illustrative embodiments have been described herein with reference to the accompanying drawings, it is to be understood that the present invention is not limited to those precise embodiments, and that various other changes and modifications may be affected therein by one of ordinary skill in the related art without departing from the scope or spirit of the invention. All such changes and modifications are intended to be included within the scope of the invention as defined by the appended claims.

What is claimed is:

1. A backlight unit for a liquid crystal display, comprising:
- at least one tube filled with discharge gas;
- a cavity resonator, wherein an end of the tube is inserted in the cavity resonator and the rest of the tube is protruded from the cavity resonator;
- a magnetron for generating microwaves and supplying the generated microwaves to the cavity resonator;
- a magnetron driver for driving the magnetron;
- a phosphor layer for converting ultraviolet light generated in the tube into visible light; and
- at least one optical sheet or at least one optical plate adjacent to the rest of the tube.

2. The backlight unit as claimed in claim 1, wherein the at least one optical sheet includes a diffusion sheet disposed above the tube, wherein the phosphor layer is formed on a surface of the diffusion sheet.

3. The backlight unit as claimed in claim 2, further comprising a reflection sheet disposed below the tube, wherein the reflection sheet includes an ultraviolet ray reflection sheet.

4. The backlight unit as claimed in claim 1, wherein the phosphor layer is formed on one of an inner or outer surface of the tube.

5. The backlight unit as claimed in claim 1, wherein the at least one optical plate includes a light guide plate, wherein:
- a side of the light guide plate is disposed adjacent to the tube, and
- the phosphor layer is formed on the side of the light guide plate disposed adjacent to the tube.

6. The backlight unit as claimed in claim 1, wherein the at least one optical plate includes a light guide plate, wherein:
- a side of the light guide plate is disposed adjacent to the tube, and
- the phosphor layer is formed on an upper surface of the light guide plate.

7. The backlight unit as claimed in claim 6, further comprising a reflection sheet disposed below the light guide plate, wherein the reflection sheet includes an ultraviolet ray reflection sheet.

8. The backlight unit as claimed in claim 5, further comprising a tube reflection sheet disposed around the tube to reflect incident light to the light guide plate, wherein the tube reflection sheet includes an ultraviolet ray reflection sheet.

9. The backlight unit as claimed in claim 1, wherein the end of the tube is inserted in the cavity resonator at a depth of about 8 mm to about 12 mm.

10. The backlight unit as claimed in claim 1, wherein a tube mounting hole is formed on a side of the cavity resonator and the end of the tube is inserted in the tube mounting hole.

11. A liquid crystal display, comprising:
- a liquid crystal display panel;
- a backlight unit for providing visible light to the liquid crystal display panel; and
- a receiving case for receiving the backlight unit therein,
- wherein the backlight unit comprises:
- a tube filled with discharge gas;
- a cavity resonator, wherein an end of the tube is inserted into the cavity resonator and the rest of the tube is protruded from the cavity resonator;
- a magnetron for generating microwaves and supplying the generated microwaves to the cavity resonator;
- a magnetron driver for driving the magnetron;
- a phosphor layer for converting ultraviolet light generated in the tube into visible light; and
- at least one optical sheet or at least one optical plate adjacent to the rest of the tube.

12. The liquid crystal display as claimed in claim 11, wherein the phosphor layer is formed on a surface of the receiving case.

13. The liquid crystal display as claimed in claim 11, wherein the magnetron driver is positioned on a surface of the receiving case.

14. The liquid crystal display as claimed in claim 11, wherein the at least one optical includes a light guide plate, wherein a first side of the light guide plate is disposed adjacent to the tube and the magnetron driver is positioned in a space between a second side of the light guide plate adjacent to the first side and sides of the magnetron and cavity resonator.

* * * * *